United States Patent [19]

Hillekamp et al.

[11] 4,094,772

[45] June 13, 1978

[54] METHOD OF AND APPARATUS FOR SORTING LIGHT REFUSE FRACTIONS

[75] Inventors: Klaus Hillekamp, Munich; Hubert Kindler, Gröbenzell, both of Germany

[73] Assignee: Krauss-Maffei Aktiengesellschaft, Munich, Germany

[21] Appl. No.: 798,487

[22] Filed: May 19, 1977

[30] Foreign Application Priority Data

May 22, 1976 Germany ..... 2623067

[51] Int. Cl.[2] ..... B07B 9/02; B07C 5/34

[52] U.S. Cl. ..... 209/12; 209/76; 209/144

[58] Field of Search ..... 209/12, 76, 77, 144, 209/109, 45, 46; 241/19, 24, DIG. 38

[56] References Cited

U.S. PATENT DOCUMENTS

| | | | |
|---|---|---|---|
| 1,153,381 | 9/1915 | Gudmundsen | 209/109 |
| 1,827,736 | 10/1931 | Coari | 209/109 X |
| 2,151,894 | 3/1939 | Cambessedes | 209/109 X |
| 3,145,937 | 8/1964 | Scovel et al. | 209/12 |

*Primary Examiner*—Frank W. Lutter
*Assistant Examiner*—Ralph J. Hill
*Attorney, Agent, or Firm*—Karl F. Ross

[57] ABSTRACT

A light refuse fraction including flat pieces of different rip resistance, such as relatively rip-resistant synthetic-resin foils and textiles and less rip-resistant paper, is separated by first suspending the material in a gas stream which is passed over an entrapment element. This entrapment element is so oriented that pieces of the material catch on it. The speed of the stream of gas relative to the entrapment element is such that the less rip-resistant pieces tear free from the entrapment element and the more rip-resistant pieces remain caught on it. Thereafter a stripper element serves to clear the more rip-resistant pieces off the entrapment element and segregate them from the less rip-resistant pieces. In this manner it is possible to recover from the light fraction separated out in a refuse-sorting plant the flat pieces of paper that are recycled for use in making paper products.

25 Claims, 9 Drawing Figures

Figures 1, 2:
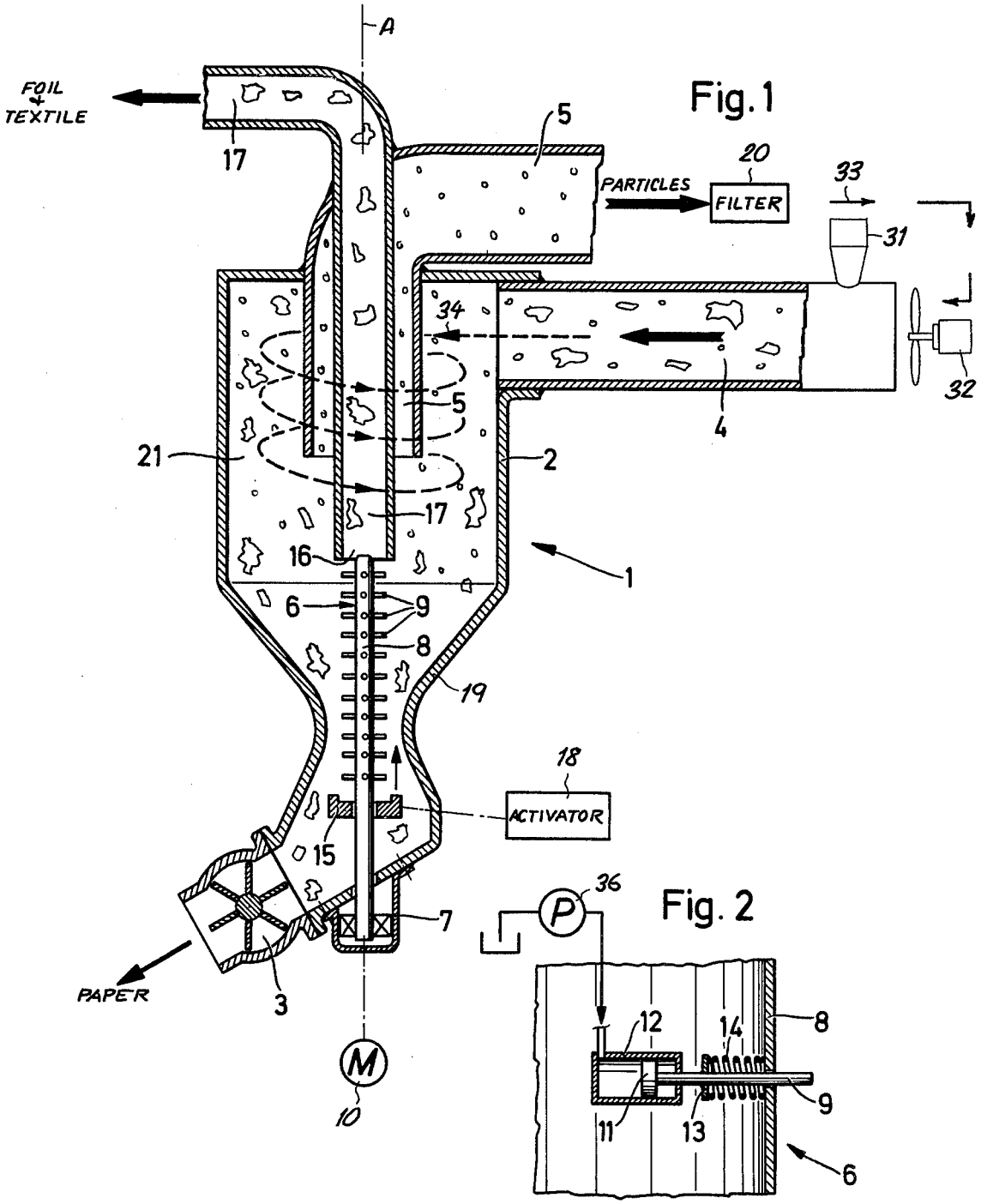
Figure 3:
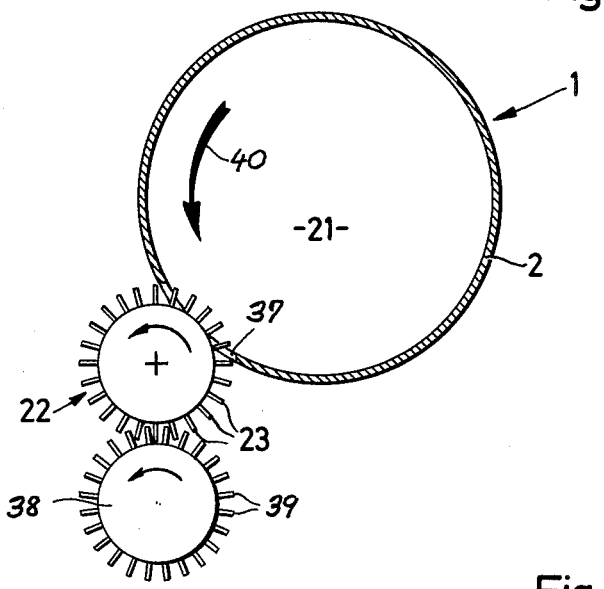

5
4
42
43
28
1
2'
23
21'
22
29
30

CIRCUIT BREAKER

Conventional high performance, manually and automatically operable, trip-free magnetic circuit breakers have been adaptable for use in series, shunt and relay trip application, for instantaneous or time delayed trip operation, for use as "flux switch" type circuit breakers where high transient currents in the breaker circuit have been anticipated, for use with auxiliary switches, and for use in multipole applications. However, such adaptability has been achieved only by substituting a substantial number of breaker components in adapting the breakers for each type of breaker operation. As a result, circuit breaker costs have been high due in part to the high unit cost of breaker components resulting from the need for many different tools and resulting from the small manufacturing volumes of some of the special breaker components. Breaker costs have also been increased by the need for maintaining a large inventory of many different breaker parts.

Most important, such conventional circuit breakers have required performance of a large number of critical hand operations during breaker assembly and calibration. These assembly operations have been time-consuming and expensive, have imposed excessive delay between customer order and delivery, have required the employment of skilled assembly personnel, have resulted in high rejection rates during assembly, have frequently prevented salvaging of components from improperly assembled breakers, and have resulted in the manufacture of breakers which have not displayed consistent performance characteristics.

For example, such known circuit breakers have frequently required welding of pigtails to movable contact arms, have utilized magnetic core means which have been soldered or cold-headed to the magnetic frame which supports the magnetic actuating coils in the breakers to obtain secure mounting of the core means relative to the coil means; and have required bending of latch components, clappers and the like at assembly to obtain proper interaction of breaker linkage systems with other breaker components. In some of the previously known circuit breakers, the collapsible linkages which have been used have required excessive riveting and in most such circuit breakers, breaker housing sections have been riveted together after breaker assembly and calibration has been completed.

Each of these assembly operations used in manufacturing the conventional circuit breakers has tended to impose cost and performance penalties. Thus, the critical hand assembly operations have been slow and expensive to perform as will be understood. They have also resulted in assembly errors which have seriously reduced manufacturing yields. Welding and soldering tend to introduce splatter which can result in immediate breaker failure or which can result in failure of the breakers during subsequent use. Welding, soldering, cold-heading and bending also tend to destroy corrosion-preventing coatings provided on some breaker components. These assembly operations also introduce material stresses such as work-hardening which are deleterious to breaker performance. For example, welding of pigtails can result in stiff pigtail movement which prevents smooth movement of the contact arm during breaker operation. The cold-heading of a magnetic core means in mounting the core means on a coil-supporting frame introduces work-hardening which can result in the build-up of residual magnetism in the cold-headed components during subsequent use of the circuit breaker. Riveting of the components of a collapsible linkage risks tight operation of the linkage which can retard proper opening of the circuit breaker. Riveting of the casing also tends to result in cracking of dielectric casing parts. Further, where such welding, soldering, cold-heading or riveting result in errors of assembly, salvaging of the welded, soldered, cold-headed or riveted parts is usually difficult and expensive.

In addition, some previously known circuit breakers have been subject to various structural deficiences which have reduced the convenience or effectiveness of their performance. For example, where the housings of such breakers have been riveted together, the rivets have sometimes contributed to arcing or shorting outside the breaker housings particularly where high overload current conditions have occurred in multipole breaker applications. In most such known breakers the collapsible linkages have been subjected to heavy loads so that all of the linkage elements have been made of metal. In such linkages, even slight corrosion of the metal elements in metal-to-metal pressure engagement can result in retardation of linkage movement and such breakers have sometimes required lubrication when used in hostile environments. In other known breakers, where a clapper is adapted to be drawn into engagement with a magnet pole face and to strike a breaker tripping element during such movement, it has been difficult to precisely position the clapper to assure proper tripping. That is, if the clapper engages the tripping element too far away from the pole face, the clapper force may be too small to initiate tripping. On the other hand if the clapper strikes the tripping element too close to the pole face, the extent of the resulting movement of the tripping element may be insufficient to effect tripping.

In some previously known circuit breakers, calibration of the breaker units has been accomplished from the side of the breaker. Accordingly, when a group of such units is used in a multipole breaker application, the calibration had to be completed before assembly of the units in the desired multipole arrangement. However, because the individual breaker units have been subject to a different magnetic environment in the multipole arrangement, such calibration prior to a final assembly has not always been fully effective. Further, the prior art techniques used for coupling breaker handles and the like in multipole applications have tended to be somewhat inconvenient to use. In addition, where previously known breakers have been used with auxiliary switches, the additional forces required for operation of the auxiliary switches have sometimes made it difficult to properly calibrate the breakers or to obtain uniform and reliable breaker performance. Similarly, where the prior art breakers have been adapted for flux switch operation, the breakers have been difficult to calibrate and have not always been adapted to withstand suitable high transient currents without nuisance tripping.

It is an object of this invention to provide a novel and improved, high performance, manually and automatically operable, trip-free magnetic circuit breaker; to provide such a circuit breaker which is of compact, rugged and inexpensive construction; to provide such a breaker which is readily adaptable at low cost for use in a wide variety of circuit breaker applications; to provide such a circuit breaker which is easily and rapidly assembled; to provide such a breaker which is adapted to be assembled without requiring hand adjustments during such assembly; to provide such circuit breakers which display consistent performance characteristics; to provide such circuit breakers which are of compact construction and small size but which display improved rupture capacity; to provide such circuit breakers which are adapted to be easily, accurately and conveniently calibrated; to provide such circuit breakers which are easily and accurately calibrated after assembly in a multipole circuit breaker arrangement; to provide such circuit breakers which are adapted to withstand substantial wear over a long service life; to provide such circuit breakers which display improved resistance to corrosion and which are significantly less subject to jamming as a result of corrosion; to provide such circuit breakers which are operable in hostile environments without requiring lubrication; to provide such circuit breakers in which build-up of residual magnetism does not tend to occur; to provide such circuit breakers from which breaker components are easily salvaged at any time; to provide such circuit breakers which do not require extensive riveting during assembly; to provide such circuit breakers which are adapted to be manufactured with high manufacturing yields; to provide such circuit breakers which are easily mounted on control panels; to provide such circuit breakers which are easily calibrated after adaptation for auxiliary switch application; to provide such circuit breakers which are conveniently coupled together for multipole operation; and to provide such circuit breakers which are easily calibrated and which display reduced nuisance tripping when adapted for flux type circuit breaker application.

Briefly described, the circuit breaker of this invention comprises a pair of dielectric casing sections fitted together to form a housing having terminal openings between the sections at one end of the housing. Abutments are provided on the exterior surfaces of the casing sections adjacent the openings, and terminals which are disposed in the openings have tabs deformed around the abutments for holding the casing sections together at that end of the housing. Mounting and cam surfaces are also provided on the exterior surfaces of the casing sections at the corners of the opposite end of the housing. Metal clips fit over these exterior casing surfaces, the clips having cam surfaces engaged with the cam surfaces on the casing sections for holding the casing sections together with a precisely predetermined force. The clips have detent means which position the clips until circuit breaker assembly has been tested and have tabs which are deformed after testing for locking the clips permanently in place. The clips are provided with tapped mounting holes. In this arrangement, the housing is easily and accurately assembled without risk of cracking the dielectric casing sections; the housing is free of rivets which might reduce electrical clearances in the breaker; if dissassembly is required, the casing sections and clips are fully reuseable; and the housing is adapted for conveniently mounting on a control panel without requiring mounting inserts in the housing.

The circuit breaker also includes an improved contact system in which a pair of first contacts are mounted in spaced relation in the housing and in which a movable contact arm is pivotally mounted on the housing for moving a bifurcated end of the arm into and out of bridging engagement with the first contacts for opening and closing the breaker circuit. The movable contact arm is normally biased to open circuit position. In this arrangement, no pigtails need be welded to the movable contact arm; a double contact break is obtained; and the arrangement of the contact arm is adapted to achieve improved blow out of arcs formed during opening of the breaker circuit. Thus the current breaker achieves more consistent performance, longer service life and improved rupture capacity.

The circuit breaker also includes an improved collapsible linkage for permitting opening and closing of the breaker circuit in response to manual movement of an operating handle and for permitting automatic opening of the breaker circuit when the linkage is tripped on the occurrence of an overload current in the circuit. In the linkage, a first link has one end pivotally connected to the operating handle and has a first latch which is engaged with the contact arm and which is pivotally mounted at the opposite end of the first link for movement between latching and unlatching positions. The first latch has a cam surface to be engaged for manually holding the first latch in its latching position. A second link having a cam follower is pivotally mounted on the first link for movement between a first position engaging the cam follower with the cam surface of the first latch for holding the first latch in its latching position and a second position in which the cam follower is disengaged from the first latch. A second latch, also pivotally mounted on the first link, is movable from a latching position holding the second link in its first position to an unlatching position in which the second link is permitted to move to its second position. A tripping member also pivotally mounted on the first link normally holds the second latch in its latching position but is trippable by an applied force for releasing the second latch for movement to its unlatching position. When the first and second latches are in the latching positions as described, movement of the operating handle between two circuit positions is effective to move the linkage through an overcenter position against the bias on the movable contact arm, thereby to hold the arm securely in closed circuit position or to permit the arm to move sharply to open circuit position. Tripping of the tripping member by an applied force on the occurrence of an overload current in the breaker circuit is also effective to collapse the linkage for permitting the contact arm to move sharply to open circuit position independently of the position of the operating handle.

In the dual latch linkage system of this invention, the links, latches and tripping member are arranged to provide cumulative mechanical advantage such that, although the movable contact arm is normally held in closed circuit position with substantial force, the tripping member is adapted to retain the second latch in its latching position with a much smaller force. Preferably also the tripping member is formed of precision molded plastic high lubricity material. In this arrangement, only a relatively light force need be applied to the tripping member for initiating automatic circuit-opening operation of the circuit breaker. Further, although the plastic tripping member is adapted to withstand the light forces applied to it without cold flow or excessive wear, the tripping member is formed with such precision that the linkage is adapted to be easily and accurately assembled inside the circuit breaker and does not require cutting, trimming or bending or the like during final circuit breaker assembly. In addition, the plastic tripping member is not subject to corrosion even in hostile environments and there is no metal-to-metal pressure contact between the plastic tripper and the second latch. Acrotated to the drum 22 so that the pieces picked up by the drum 22 can be stripped from its pins 23. The drum 22 is rotated in a direction against the direction 40 in which the particles and flat pieces move inside the chamber 21. The relative velocities of the pins 23 and of the gas stream in suspension in the chamber 21 are such that paper pieces rip from the pins 23 but the heavier-duty foil and textile pieces are pulled therefrom so that they can be stripped from this by the stripper pins 39.

Figure 4A:
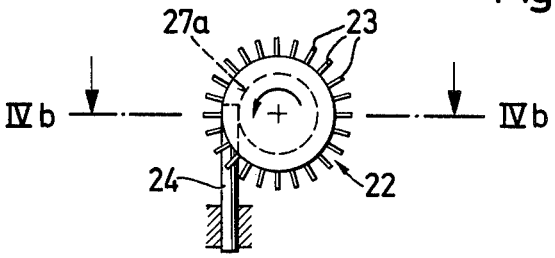
Figure 4B:
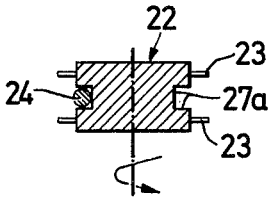

FIGS. 4*a* and 4*b* show how instead of the stripper drum 38 with its pins 39 one or more rods 24 may be provided with each engaged in a groove 27*a* formed in the drum 22 between its pins 23. As the drum 22 rotates past the stationary rod 24 the flat pieces engaged on its pins 23 are therefore automatically stripped from it.

Figure 5:
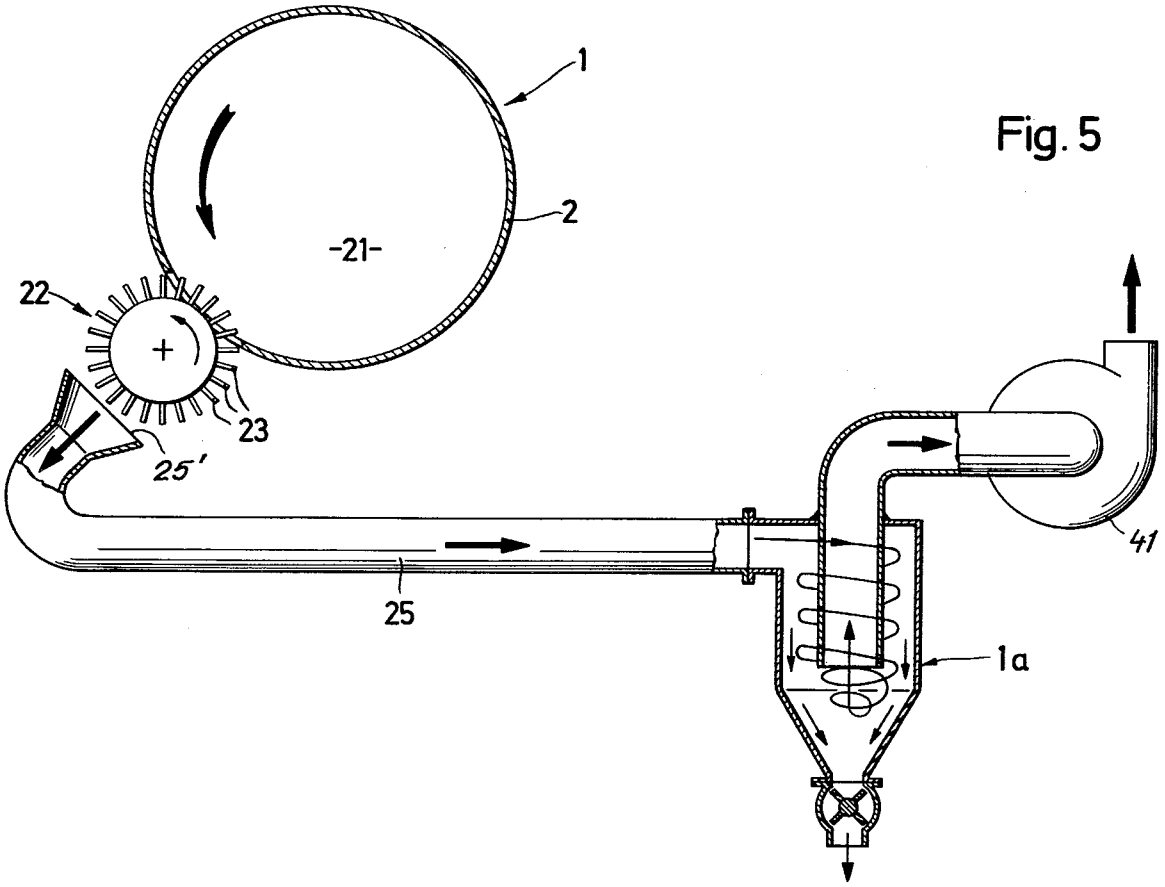

In FIG. 5 an arrangement is shown wherein a suction tube 25 has a mouth 25' which opens radially of the drum 22. The other end of the conduit 25 opens tangentially into another cyclone 1*a* connected at its downwardly open axial outlet to the axial input of a squirrel-cage blower 41. The second cyclone 1*a* separates out the textile and synthetic-resin foil pieces from the stream in the conduit 25.

Figure 6:
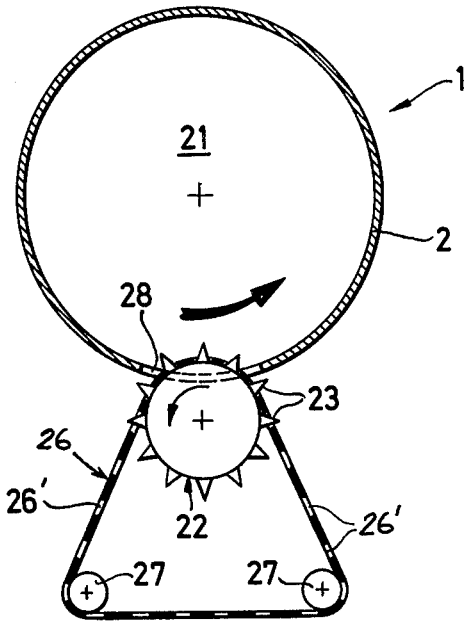

In FIG. 6 an arrangement is shown wherein the spikes 23 of the drum 22 engage through an opening 28 in the cylindrical wall 2 of the cyclone 1. A belt 26 having a multiplicity of perforations 26' is spanned over the drum 22 and over a pair of idler wheels or cylinders 27. The perforations 26' of the belt 26 are spaced so that the pins 23 can engage through them. Furthermore the belt is engaged tightly over the drum 22 where it reaches through the hole 28 so that the pins 23 project through the belt. Thus these pins 23 can pick up the more rip-resistant pieces in the suspension inside the chamber 21. As the drum 22 rotates, therefore, it will pull these more rip-resistant pieces outside through the hole 28. The pins 23 will then, however, pull out of the holes 26' so that the flat pieces engaged on them will automatically be stripped off.

Figure 6A:
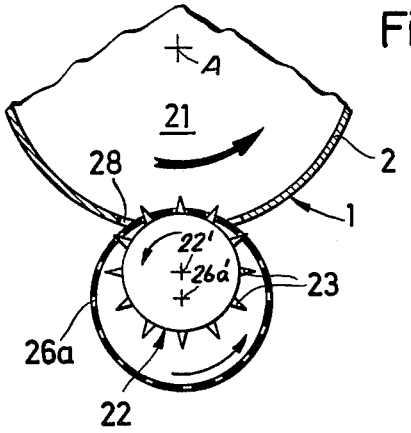

FIG. 6*a* shows another arrangement wherein the belt 26 is replaced by a perforated drum 26*a* of cylindrical shape having a center of rotation 26*a'* set off from the center 22' of the drum 22 radially outwardly from the axis A of the chamber 21. Thus this rigid cylindrical drum 26*a* will strip flat pieces off the pins 23 in the same manner as the belt 26.

Figure 7:
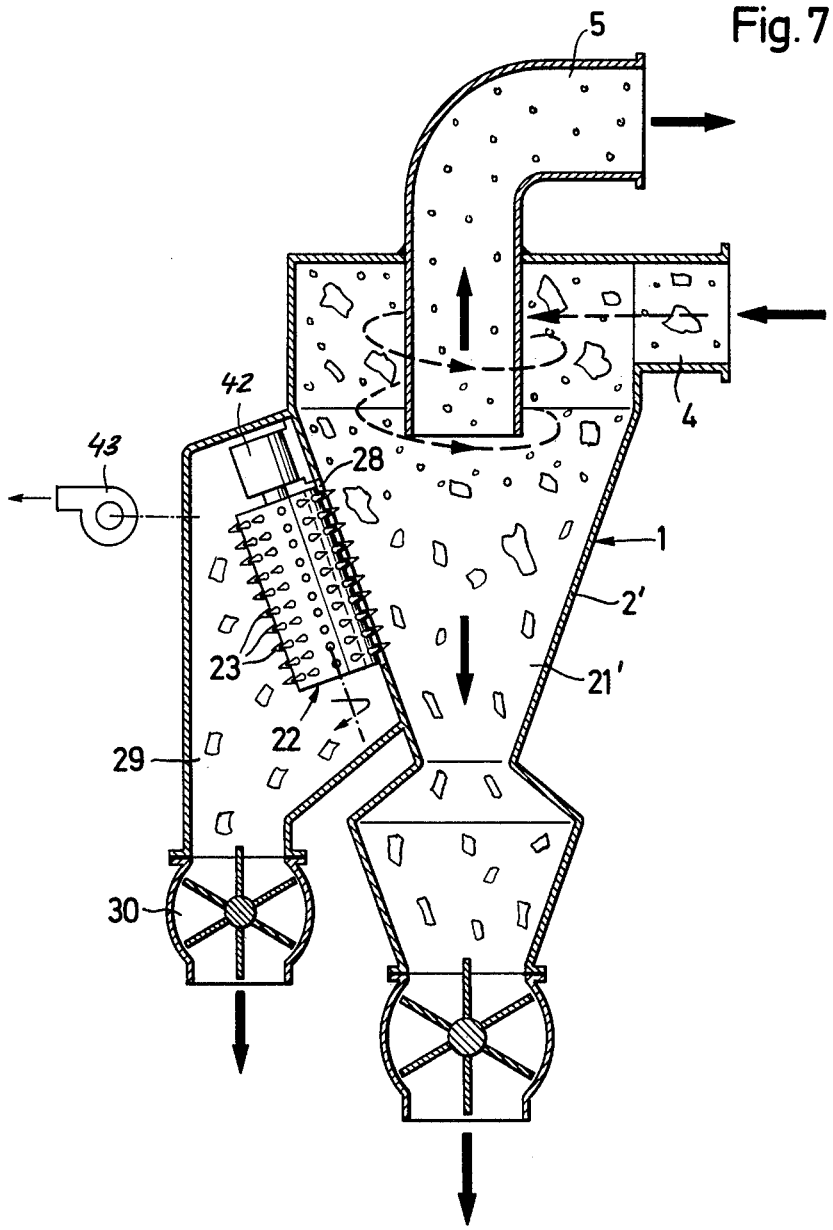

Finally FIG. 7 shows yet another arrangement wherein a drum 22 having pins 23 and rotatable by means of a motor 42 extends through a laterally open hole 28 in the side of a frustoconical wall 2' of another cyclone not provided with the outlet 17. A second chamber 29 having its own outlet airlock-type gate 30 is kept under subatmospheric pressure by means of a blower 43. A stripping element 26 or 26*a* such as shown in FIGS. 6 or 6*a* can be used on the drum 23 but is not shown in FIG. 7. The chamber 29 ensures that the use of a drum 22 engaging through a hole 28 will not depressurize the chamber 21' which is here of downwardly tapering rather than cylindrical shape as shown in FIG. 1.

With the system of the present invention it is therefore a relatively easy matter to separate more rip-resistant flat pieces, thereby automatically segregating paper on the one side and textiles and syntehtic-resin foils on the other. This allows the light fraction recovered in a refuse-sorting plant to be separated into two further subfractions, one of which is eminently usable by a paper plant for making paper again.

Any of the elements of any of the embodiments described above can be used in any of the other embodiments described above without in any manner departing from the scope of the instant invention.

We claim:

1. A method of sorting material including flat pieces of different rip resistance, said method comprising the steps of:

suspending said material in a gas stream;

passing said stream with said material suspended therein over an entrapment element;

orienting said entrapement element relative to said stream so that pieces of said material catch thereon; and setting the speed of said stream of gas relative to said element so that the less rip-resistant pieces tear free from said element and the more rip-resistant pieces remain caught on said element.

2. The method defined in claim 1, further comprising the step of separating the more rip-resistant pieces from said element and segregating said more rip-resistant pieces from the less rip-resistant pieces.

3. The method defined in claim 2 wherein said stream with said material suspended therein is passed generally in a helix centered on an axis, said element being oriented generally at said axis.

4. The method defined in claim 2 wherein said stream with said material suspended therein is passed generally in a helix centered on an axis, said element extending radially from outside into said helix offset from said axis.

5. The method defined in claim 2 wherein said stream is passed along a generally straight path past said element.

6. The method defined in claim 2 wherein said more rip-resistant pieces caught on said element are separated therefrom by suction.

7. The method defined in claim 2 wherein said more rip-resistant pieces caught on said element are separated therefrom by physical engagement with said more rip-resistant pieces of a stripping element displaceable relative to said entrapment element.

8. An apparatus for sorting material including flat pieces of different rip resistance, said apparatus comprising:

a housing defining an elongated flow path;

an entrapment element in said housing projecting into said path;

blower means for passing a stream of gas in which said pieces are suspended along said path and over said element at a predetermined speed such that said pieces catch on said element but only the more rip-resistant pieces remain caught thereon, the less rip-resistant pieces tearing free from said element; and means for stripping the more rip-resistant pieces caught on said entrapment element therefrom and for displacing said more rip-resistant pieces out of said housing.

9. The apparatus defined in claim 8 wherein the stripping means includes a stripping member displaceable relative to said entrapment element.

10. The apparatus defined in claim 9 wherein said housing is constituted as a cyclone and said path is at least partially generally helical and centered on an axis.

11. The apparatus defined in claim 10 wherein said element is generally at said axis.

12. The apparatus defined in claim 11 wherein said element is constituted by a holder lying generally at said axis and a plurality of pins extending radially from said holder.

13. The apparatus defined in claim 12, further comprising means for retracting said pins radially into said holder, said stripping member being axially displaceable along said holder after retraction of said pins to strip pieces from said holder.

14. The apparatus defined in claim 10 wherein said entrapment element includes at least one pin projecting radially from outside into said path, said stripping means including means for displacing said pin out of said housing and out of said path.

15. The apparatus defined in claim 14 wherein said entrapment element includes a holder carrying a plurality of such pins.

16. The apparatus defined in claim 15 wherein said holder is formed between said pins with a circumferential groove and is rotatable about a holder axis, said stripping member being arranged tangential to said holder and having an end engaging in said groove.

17. The apparatus defined in claim 15 wherein said stripping member includes an annular element formed with a plurality of throughgoing holes which said pins can engage, said stripping means further including means for orienting said annular element close to said holder at said path with said pins projecting therethrough, and for displacing said annular element away from said holder outside said housing to radially strip the more rip-resistant pieces therefrom.

18. The apparatus defined in claim 17 wherein said annular element is a perforated belt.

19. The apparatus defined in claim 17 wherein said annular element is a perforated generally rigid drum oscillating said holder at said housing.

20. The apparatus defined in claim 10 wherein said stripping means includes a second housing adjacent and connected to the first-mentioned housing at said entrapment element, said second housing being closed.

21. The apparatus defined in claim 20, further comprising means for maintaining said second housing at lower pressure than said first housing.

22. The apparatus defined in claim 10 wherein said path changes direction at a predetermined location, said entrapment element being at said location.

23. The apparatus defined in claim 8 wherein said means for stripping includes means for sucking said more rip-resistant pieces off said element.

24. The apparatus defined in claim 8, further comprising means for continuously displacing said element relative to said stream.

25. The apparatus defined in claim 8 wherein said housing is formed generally as a cyclone having a tangential input connected to said blower means, an axially central outlet juxtaposed with said entrapment element for receiving said more rip-resistant pieces, and an axial outlet surrounding said central outlet for receiving particulate nonflat pieces.

* * * * *